United States Patent [19]

Brown

[11] 4,429,371

[45] Jan. 31, 1984

[54] RELATIVE HORSEPOWER INDICATOR

[75] Inventor: Morton E. Brown, San Antonio, Tex.

[73] Assignee: Southern Gas Association, Dallas, Tex.

[21] Appl. No.: 246,289

[22] Filed: Mar. 23, 1981

[51] Int. Cl.[3] ..... G06G 7/19; G06G 7/64

[52] U.S. Cl. ..... 364/803; 364/551

[58] Field of Search ..... 364/803, 819, 821, 431.02, 364/511, 551; 324/142

[56] References Cited

U.S. PATENT DOCUMENTS

| | | | |
|---|---|---|---|
| 2,936,041 | 5/1960 | Sharp et al. | 181/206 |
| 2,951,638 | 9/1960 | Hughes et al. | 364/803 |
| 2,979,940 | 4/1961 | Damewood et al. | 73/659 |
| 2,997,124 | 8/1961 | Damewood et al. | 181/233 |
| 3,084,863 | 4/1963 | Du Val | 324/142 X |
| 3,226,641 | 12/1965 | Miller | 324/142 |
| 3,961,257 | 6/1976 | Milkovic | 324/142 |
| 4,055,803 | 10/1977 | Kraley et al. | 324/142 |
| 4,307,616 | 12/1981 | Vasile | 364/821 X |

OTHER PUBLICATIONS

Harris et al.: Shock and Vibration Handbook, McGraw Hill Book Co., 1961, pp. 22–23 to 22–26.

*Primary Examiner*—Felix D. Gruber

*Attorney, Agent, or Firm*—Hubbard, Thurman, Turner & Tucker

[57] ABSTRACT

A relative horsepower indicator is used with an electrical model of a reciprocating gas compressor. A voltage representing the cylinder motion is modified and multiplied with a voltage representing the cylinder pressure. The result is calibrated to indicate one hundred percent cylinder horsepower when the model is operated under ideal conditions. The indicator is then used to indicate deviations from this ideal operating mode when the compressor model is used in a complete pumping system model.

6 Claims, 3 Drawing Figures

RELATIVE HORSEPOWER INDICATOR

BACKGROUND OF THE INVENTION

The present invention relates generally to an electrical model of a gas pumping system and more specifically to an apparatus for measuring relative horsepower changes in the output of each model cylinder under various system operating conditions.

Installation or modification of natural gas or other fluid distribution systems requires consideration of a number of factors before work is undertaken. Variations in loads, distribution paths, pipe sizes and compressor speeds all have effects on the operation of the system as a whole. Compression waves created in the gas by the operation of reciprocating pumps and compressors are especially troublesome as resonances can be set up in the system. Acoustical resonance increases metal fatigue and shortens the life of joints, valves and other components of the system.

To assist in planning for the control of undesirable pulsations and vibrations in a system, an electrical analog of all fluid transfer components can be created. Present electrical systems analogize current to mass flow of the gas and voltage to pressure. Inductors, capacitors and resistors are used to model the mechanical properties of pipes and other components in the distribution system. A detailed model of a distribution system or subsystem can be set up and studied to predict the effects caused by changing various parameters in the operation of the system. Examples of the use of gas pumping system analogs are found in U.S. Pat. Nos. 2,951,638 and 2,979,940.

In order to utilize easily obtained components, the operating frequency of the electrical analog is typically substantially higher than that of the mechanical system. An electrical to mechanical frequency ratio describes this relationship. Component values and analog system parameters are chosen so that all events which occur during the operation of the analog reflect events which will take place in the mechanical system. For example, the presence of an electrical resonance in the analog system at a certain frequency corresponds to a mechanical resonance at the corresponding mechanical speed.

One model of a reciprocating compressor or pump includes a capacitor which is driven by an AC voltage source. The signal source models the mechanical input, usually an electric motor or internal combustion engine, which is used to drive the compressor. The capacitor models the cylinder itself. Some imprecision is introduced into the model because the capacitance remains constant while the volume of the cylinder is constantly changing. To compensate for this, a sinusoidal cylinder driving signal is shaped by appropriate circuitry to enlarge the positive lobe of the signal and diminish the negative lobe.

Important information about the operation of the system is available from measurements of changes in cylinder horsepower under different operating conditions. It is desirable that each cylinder operate as near to ideal conditions as possible, with deviations from ideal operation normally indicating a lowered efficiency of the compressor.

In the prior art, difficulty has been encountered in accurately measuring changes in horsepower of each cylinder. Since cylinder output horsepower is proportional to the pressure-volume integral, the present method for determining relative changes in horsepower begins with taking a photograph of the ideal pressure-volume diagram. This photograph is made with the model cylinder pumping into large volume. This photograph is then planimetered, and a value proportional to cylinder horsepower is determined. This process is then repeated with the cylinder model inserted into the system, and a second value proportional to horsepower determined from the operating pressure-volume diagram. A change in horsepower under operating conditions is then determined from these two values.

This procedure has the obvious disadvantages that the determination of changes in horsepower are complicated and prone to error. This procedure must be undertaken separately for each cylinder in the model. Additionally, the entire process must be undertaken again every time any part of the system is changed, or when operating conditions, such as compressor speed, are changed.

SUMMARY OF THE INVENTION

It is therefore an object of the present invention to provide an apparatus which automatically indicates proportional changes in cylinder horsepower.

It is a further object of the present invention to provide that this apparatus may be initially calibrated, and then needs no further calibration.

It is another object of the present invention that the apparatus can indicate horsepower changes as a percentage of the cylinder horsepower output under ideal operating conditions.

Therefore, according to the present invention, the model voltage corresponding to pressure and the model driving signal are continuously determined. The driving signal is phase shifted, and the shifted signal and the model pressure signal are multiplied together. The product output is calibrated and integrated prior to being measured by a display device.

The novel features which characterize the present invention are defined by the appended claims. The foregoing and other objects and advantages of the invention will hereinafter appear, and for purposes of illustration, but not of limitation, a preferred embodiment is shown in the accompanying drawings.

DETAILED DESCRIPTION OF THE PREFERRED EMBODIMENT

Figure 1:
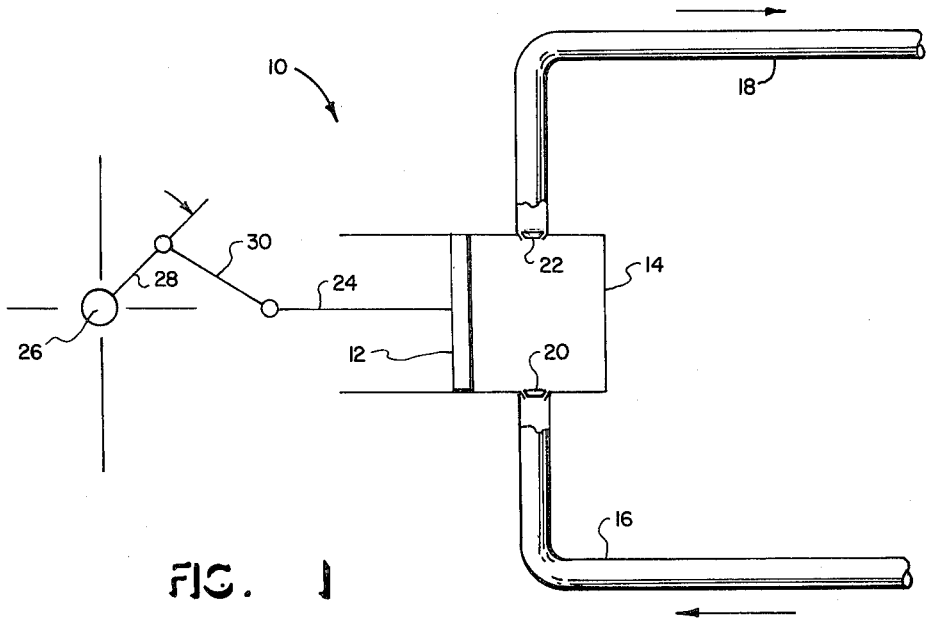
FIG. 1 is a schematic diagram of a single cylinder reciprocating compressor.

In FIG. 1, a schematic representation of a single cylinder reciprocating gas compressor is indicated generally by the reference numeral 10. Compressors used with gas distribution systems are usually comprised of a plurality of cylinders arranged on a common crankshaft, but for discussion purposes the electrical analog of only a single cylinder will be shown. It will be apparent to those skilled in the art that a plurality of these models can be used to model a multi-cylinder compressor.

In the single cylinder compressor 10, a piston 12 reciprocates in a cylinder 14. An intake line 16 and a discharge line 18 are connected to the cylinder 14. A suction valve 20 and a discharge valve 22 control the flow of gases through the pipes 16, 18 and the cylinder 14. A piston rod 24 is fixed to the piston 12 and is connected to a power input shaft 26 through a crank 28 and a connecting rod 30. Movement of the piston 12 is caused by rotation of the crankshaft 26.

The input shaft 26 is coupled to a prime mover (not shown) such as in internal combustion engine or electric motor. As the prime mover rotates the shaft 26, the piston 12 alternately draws gas at a relatively low pressure into the cylinder 14, and expels the gas at high pressure through the discharge valve 22. The movement of the piston 12 is approximately sinusoidal with time due to the rotation of the shaft 26.

When the piston 12 begins its downstroke, the pressure of the gas contained in the cylinder 14 drops due to expansion. High pressure gas in the discharge pipe 18 is prevented from reentering the cylinder 14 by the presence of the discharge valve 22, which is a one-way valve. When the pressure of gas in the cylinder 14 decreases below the static pressure of the gas in the suction pipe 14, the intake valve 20 opens and gas enters the cylinder 14. When rotation of the shaft 26 causes the piston 12 to begin its upstroke, the pressure of the gas in the cylinder 14 will increase, which closes off the one-way intake valve 20. Further movement of the piston 12 causes the fixed mass of gas in the cylinder to be trapped in a decreasing volume, thus raising its pressure. When the pressure of the gas within the cylinder 14 rises above that in the discharge line 18, the discharge valve 22 opens and the gas passes from the cylinder 14 into the discharge tube 18. When the piston 12 reverses and begins another downstroke, the discharge valve 22 will close.

Figure 2:
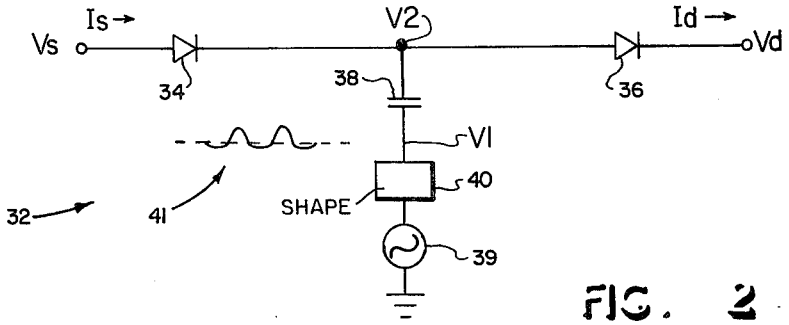
FIG. 2 is an electrical circuit analog of the compressor of FIG. 1; and, FIG. 3 is a block diagram of an apparatus for measuring changes in cylinder horsepower.

Referring to FIG. 2, an electric circuit 32 which models the action of the reciprocating pump 10 is shown. In this analog 32, electric current corresponds to a mass flow of gas and voltage corresponds to pressure. The electric currents and voltages are directly proportional to the mass and pressure of the gas, so that an increase in current flow or voltage corresponds to an increase in mass flow or pressure in the mechanical system.

In the electrical analog, a first diode 34 models the intake valve 20 of the compressor, and a second diode 36 models the discharge valve 22. A fixed voltage Vs models the static pressure of the gas in the intake piping 16, while current Is models the gas flow into the piping 16. Voltage Vd represents the static pressure in the discharge pipe 18, and current Id represents the gas flow through the pipe 18. When appropriately driven, a capacitor 38 models the cylinder 14 itself, while the prime mover mechanical input is modeled by voltage V1.

The cylinder 14 has a constantly changing volume so that capacitor 38, which has a fixed value, is not a precisely accurate model. To compensate for this, the shape of the output from a sinusoidal signal source 39 is modified in a shaping circuit 40, giving a waveshape 41 to the voltage V1. Waveform 41 is basically a sinusoidal signal with expanded positive lobes and diminished negative lobes. Experience has shown this modification to give accurate results when V1 is properly shaped.

Operation of the electrical analog 32 will be discussed in connection with the mechanical model of FIG. 1. The position of the piston 12 varies in step with the modified voltage V1. That is, when the piston 12 has reached the top of the upstroke, the voltage signal V1 from the source 40 reaches its peak. The downstroke of the piston 12 corresponds to a falling voltage V1, and the upstroke of the piston 12 corresponds to a rising voltage V1.

A cylinder pressure voltage V2 models the pressure of gas in the cylinder 14. The mass of gas in the cylinder is modeled by the electric charge on the capacitor 38. Changing capacitor charge caused by the current flow Is, Id through the diodes 34, 36 corresponds to changes in the amount of gas present in the cylinder caused by flow through the valves 20, 22. It will be appreciated that the voltage across the capacitor 38, which is the difference between voltages V1 and V2, varies directly with the charge on the capacitor 38, and remains constant when the capacitor charge is constant. Changes in the driving voltage V1 while the capacitor charge is constant cause corresponding changes in the pressure voltage V2.

When the piston 12 begins its downstroke, the signal voltage V1 begins to fall from its peak value. At this point, the cylinder pressure voltage V2 is also at its peak value. As the signal voltage V1 begins to fall, the cylinder voltage V2 also begins to fall. When the cylinder voltage V2 falls below the intake pressure voltage Vs, the intake diode 34 will be turned on, which is analogous to the intake valve 20 opening. It will be appreciated that a small forward bias voltage appears across the diode 34, but this voltage will be ignored for the purposes of this discussion.

As the cylinder voltage V2 begins to drop below the suction voltage Vs, current Is flows through the intake diode 34 and charges the capacitor 38. The capacitor 38 is charged at a rate which causes the pressure voltage V2 to remain constant, and substantially equal to the intake pressure voltage Vs. The second, or discharge, diode 36 is reverse biased because the discharge voltage Vd is higher than the cylinder voltage Vs, so that no current flows through the discharge diode 36. When the piston 12 reaches the bottom of its downstroke, the signal voltage V1 reaches its minimum value. As the piston 12 begins the upstroke, the signal voltage V1 begins to rise. The current Is which has passed through the intake diode 34 has charged the capacitor 38, causing a voltage to appear across it. As the signal voltage V1 rises, the cylinder voltage V2 rises also.

When the cylinder voltage V2 begins to rise, the intake diode 34 becomes reverse biased and ceases to conduct current. At this point, the charge on the capacitor 38 remains fixed. This corresponds to the mass of gas trapped in the cylinder 14 remaining fixed. When the cylinder pressure voltage V2 increases beyond the static discharge voltage Vd, the discharge diode 36 becomes forward biased and conducts current Id. This corresponds to the pressure in the cylinder 14 increasing about that in the discharge pipe 18.

As the voltage V1 increases, current Id flows from the capacitor 38 through the discharge diode 36. It will be appreciated that the cylinder voltage V2 cannot rise above the discharge voltage Vd by an amount greater than the forward bias voltage of the second diode 38.

When the piston 12 reaches the peak of its upstroke the signal voltage V1 reaches its maximum and current ceases to flow through the discharge diode 38. As the piston 12 begins its next downstroke, the voltage V2 begins to drop, causing the discharge diode 38 to become reverse biased. The cycle as described above is then repeated.

The capacitor 38, in combination with the driving signal 40, operates as a charge pump to transfer charge from a lower voltage to a higher voltage. This action is analogous to the manner in which the pump 10 transfers gas from a lower to a higher pressure.

Variations in the electrical model of a pump 10 are known in the art. However, the apparatus for measuring relative horsepower changes can be used with any reciprocating pump model which utilizes a capacitive pump and an approximately sinusoidal driving signal.

It is often necessary to determine the percentage increase or decrease in cylinder horsepower due to dynamic loading or unloading of the compressor. This may be accomplished on the electrical model of the system, whereby the desirability of various changes to the mechanical system can be determined.

To use the apparatus of the present invention, it is not necessary to compute the absolute cylinder horsepower. Instead, the apparatus measures only changes in the horsepower level. The apparatus is calibrated with the pump running under an ideal load, and the horsepower output relative to this ideal is determined when the pump is used in a complete system.

Cylinder horsepower can be calculated from the following equation:

$$Hp = K \int p \, dV \tag{1}$$

Where Hp is horsepower, K is a constant relating horsepower to work, p is cylinder pressure and V is cylinder volume. Since the object of the present invention is to indicate relative changes in horsepower, the constant is not necessary and we need only look at the integrand of equation (1). Cylinder pressure in the mechanical system is modeled by voltage V2 in the electrical system, and an equation for mechanical volume V as a function of angular crankshaft position $\theta$ is:

$$V(\theta) = Vol(m) - Vol(s) \cos \theta \tag{2}$$

Where Vol(m) is the cylinder volume with the piston in the center of its travel, and Vol(s) is $\frac{1}{2}$ the total volume swept by the face of the piston. $\theta$ is zero when the piston has reached its midpoint of travel on the upstroke. By differentiation:

$$dV = Vol(s) \sin \theta \, d\theta \tag{3}$$

Since the present invention is concerned only with proportional changes and not with absolute values, the constant Vol(s) is ignored. Since the analog driving signal from the source 39 is represented by cos $\theta$, sin $\theta$ (dV) is obtained by phase shifting such driving signal 90°.

Figure 3:
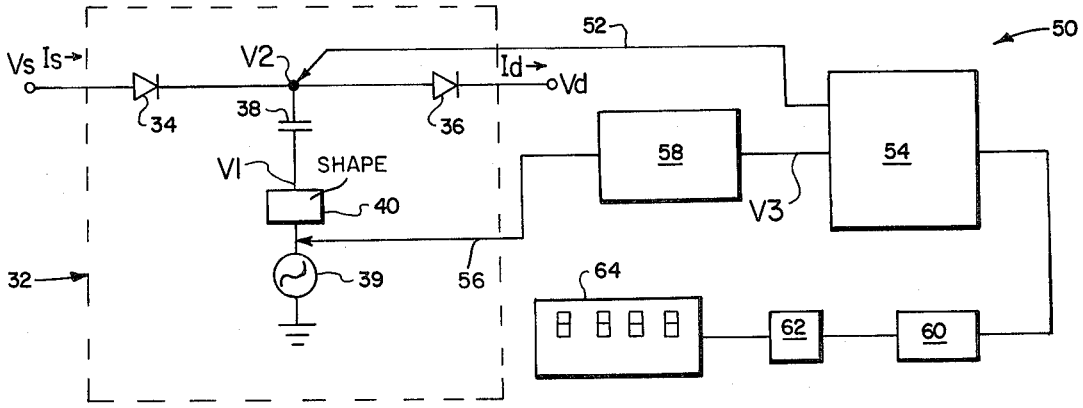

A device 50 for indicating relative horsepower is shown in FIG. 3. A first test lead 52 is coupled to the capacitor 38 to measure voltage V2. The other end of this lead is coupled to a first input of a multiplier 54. A second test lead 56 is coupled to the output of the signal source 39, and the other end of the second lead 56 is connected to a phase shifter 58. The phase shifter 58 shifts the output of the source 39 through an angle of +90°. The output voltage V3 from the phase shifter 58 is coupled to a second multiplier 54 input. The output of the mulitplier 54 is the product of the cylinder voltage V2 and the shifted driving signal voltage V3. In a preferred embodiment, the multiplier 54 is a precision analog multiplier.

The voltage output level of the multiplier 54 is adjusted in a calibration device 60, the output of which, in turn, is coupled to an integrator 62. The calibrator 60 is preferably a voltage amplifier having an adjustable gain. The integrator output is coupled to a meter 64, which preferably utilizes a digital display.

In operation, the first and second leads 52, 56 are attached to the appropriate points in the cylinder model 32. The model cylinder 32 is connected into a network representing ideal conditions, such as pumping into a large volume. The output device 64 can be marked in percentages, and the calibration device 60 is adjusted so that the meter 64 reads 100% under ideal operating conditions.

The model cylinder 32 is then coupled into the operational network, and horsepower deviation from the ideal level will be indicated in percentages on the output meter 64. In this manner, it is possible to change various parameters in the piping and pumping system, and observe the net effects on horsepower output in each cylinder.

Although a preferred embodiment has been described in detail, it should be understood that various substitutions, alterations, and modifications may become apparent to those skilled in the art. These changes may be made without departing from the spirit and scope of the invention as defined by the appended claims.

What is claimed is:

1. A device for measuring relative changes in analog horsepower in an electrical model of a reciprocating compressor wherein the electrical model has a substantially sinusoidal driving voltage for modelling the position of the compressor piston and wherein the compressor pressure is modelled by an electrical pressure voltage, wherein the measuring device comprises:

means for measuring the driving voltage in the electrical model;

a phase shifter having a shifted output voltage, wherein the shifted output represents the driving voltage shifted 90°;

product means for obtaining the product of the pressure voltage in the electrical model and the shifted output voltage;

means for integrating the output from said product means; and means for indicating the integrated signal level as a proportion of a preselected signal level.

2. The apparatus of claim 1 wherein said product means comprises a precision analog multiplier.

3. The apparatus of claim 1 wherein said indicating means comprises a digital voltmeter.

4. The apparatus of claim 1 wherein said integrating means comprises a voltage integrator.

5. A method for measuring proportional deviation from a preselected level of horsepower in an electrical model of a reciprocating pump wherein the pump includes an instantaneous pressure voltage and an instantaneous driving voltage, comprising the steps of:

a. coupling the model into a network representing selected conditions;

b. shifting the phase of the driving voltage 90 degrees;

c. detecting a pressure voltage which corresponds to the gas pressure in the reciprocating pump;

d. multiplying the pressure voltage by the shifted driving voltage to generate a product voltage;

e. integrating the product voltage;

f. indicating the integrated product voltage;

g. calibrating the indicated voltage so that a value repesenting unity is indicated;

h. coupling the model into a network representing the conditions to be tested; and i. repeating steps b. through f.

6. The method of claim 5 wherein step d. comprises an analog multiplication.

* * * * *